US006962027B2

(12) United States Patent
Zawinsky

(10) Patent No.: US 6,962,027 B2
(45) Date of Patent: Nov. 8, 2005

(54) MASONRY ATTACHMENT PIN AND METHOD OF USE

(76) Inventor: Michael L. Zawinsky, 5693 Bordley Dr., Houston, TX (US) 77056

( * ) Notice: Subject to any disclaimer, the term of this patent is extended or adjusted under 35 U.S.C. 154(b) by 253 days.

(21) Appl. No.: 10/102,356

(22) Filed: Jul. 25, 2002

(65) Prior Publication Data

US 2004/0112004 A1 Jun. 17, 2004

Related U.S. Application Data

(60) Provisional application No. 60/277,395, filed on Mar. 20, 2001.

(51) Int. Cl.[7] ..... E04B 2/00

(52) U.S. Cl. ..... 52/585.1; 52/745.21; 52/747.12; 124/26

(58) Field of Search ..... 52/585.1, 745.21, 52/747.12, 565, 98, 235, 127.2; 124/26, 16, 27

(56) References Cited

U.S. PATENT DOCUMENTS

| | | | | |
|---|---|---|---|---|
| 3,888,055 A | * | 6/1975 | Gallo | 52/98 |
| 4,266,890 A | | 5/1981 | Hilfiker | |
| 4,454,699 A | | 6/1984 | Strobl | |
| 4,545,167 A | | 10/1985 | Brock | |
| 5,657,593 A | | 8/1997 | Eriksen | |
| 6,112,733 A | * | 9/2000 | Wooten et al. | 124/26 |

* cited by examiner

*Primary Examiner*—Naoko Slack
(74) *Attorney, Agent, or Firm*—Locke Liddell & Sapp LLP

(57) ABSTRACT

A masonry pin assembly and method of use is provided for aligning and setting masonry materials used in construction. A masonry pin assembly is provided having a substantially cylindrical cartridge, a spring residing within the cartridge and reacting against the cartridge, a pin slidably disposed within the cartridge such that when the spring is fully compressed the outer end of the pin is still within the cartridge and a trigger for releasing the pin from the cartridge, thereby aligning a masonry stone with adjacent stones.

20 Claims, 4 Drawing Sheets

MASONRY ATTACHMENT PIN AND METHOD OF USE

Citation To Related Application

This application claims priority benefit of co-pending provisional application No. 60/277,395 filed on Mar. 20, 2001.

BACKGROUND OF THE INVENTION

1. Field of the Invention

The present invention relates generally to an improved pin for aligning and setting masonry stones and more specifically to a spring loaded pin and cartridge assembly and method of use.

2. Description of the Related Art

It is common in the construction industry to use masonry stones as non-structural or quasi-structural siding or cladding for buildings. Typically, such stones are aligned one to another and held in place using metal dowels or pins and an adhesive, such as mortar. For new construction, this technology is usually implemented by assembling the stones in a vertical manner, that is, from the bottom up. A hole or holes are drilled into the top edge surface of the bottom stone and metal dowels are set therein along with the adhesive. The top stone has corresponding holes drilled in its bottom edge surface to accept the protruding pins. A hole or holes may be drilled into the top face of the top stone and the process is repeated. In addition, it is also known to use horizontal pins in conjunction with vertical pins.

Restoration of existing construction often requires the removal and replacement of individual stones without removal of the surrounding stones. It is generally not possible for the replacement stone to utilize the drilled hole and dowel pin assembly process described above with respect to new construction. Typically, the replacement stone must have grooves or slots that are open to the building face of the stone, rather than holes drilled into the edges surfaces of the stone, so that the retrofit stone may be placed in position and held with adhesive. It will be appreciated that the strength of this method is dependent almost solely upon the strength of the adhesive.

The present invention, as described more fully herein, is directed to an improved alignment pin that increases the strength of retrofitted stones and decreases the time and cost of restoration.

SUMMARY OF THE INVENTION

In summary of the appended claims, a masonry pin assembly is provided that comprises a hollow elongated body and having an interior surface that is obstructed at one end. A spring resides within the body and is dimensioned to fit within the body and configured to react against the obstructed end. A pin is dimensioned to slidably reside within the body and to have a length such that substantially all of the spring and pin can reside within the body. A retainer is provided for holding the pin within the body against expulsion therefrom by the spring until such time as the retainer is deactivated from outside the masonry in which the pin assembly resides.

The foregoing summary is not intended to describe or foreshadow every potential embodiment of the invention, but merely the subject matter of the claims of this particular patent.

BRIEF DESCRIPTION OF THE DRAWINGS

The present invention can be best understood by discussion of a preferred embodiment and upon reading the following detailed description and with reference to the attached drawings, in which.

DESCRIPTION OF ILLUSTRATIVE AND PREFERRED EMBODIMENTS

The present invention is particularly suited to new stone installation with single or multiple alignment pin orientation and to replacement stone installation with single or multiple alignment pin orientation. To more fully understand the present invention, it will first be compared and contrasted with prior art methods.

Figure 1:
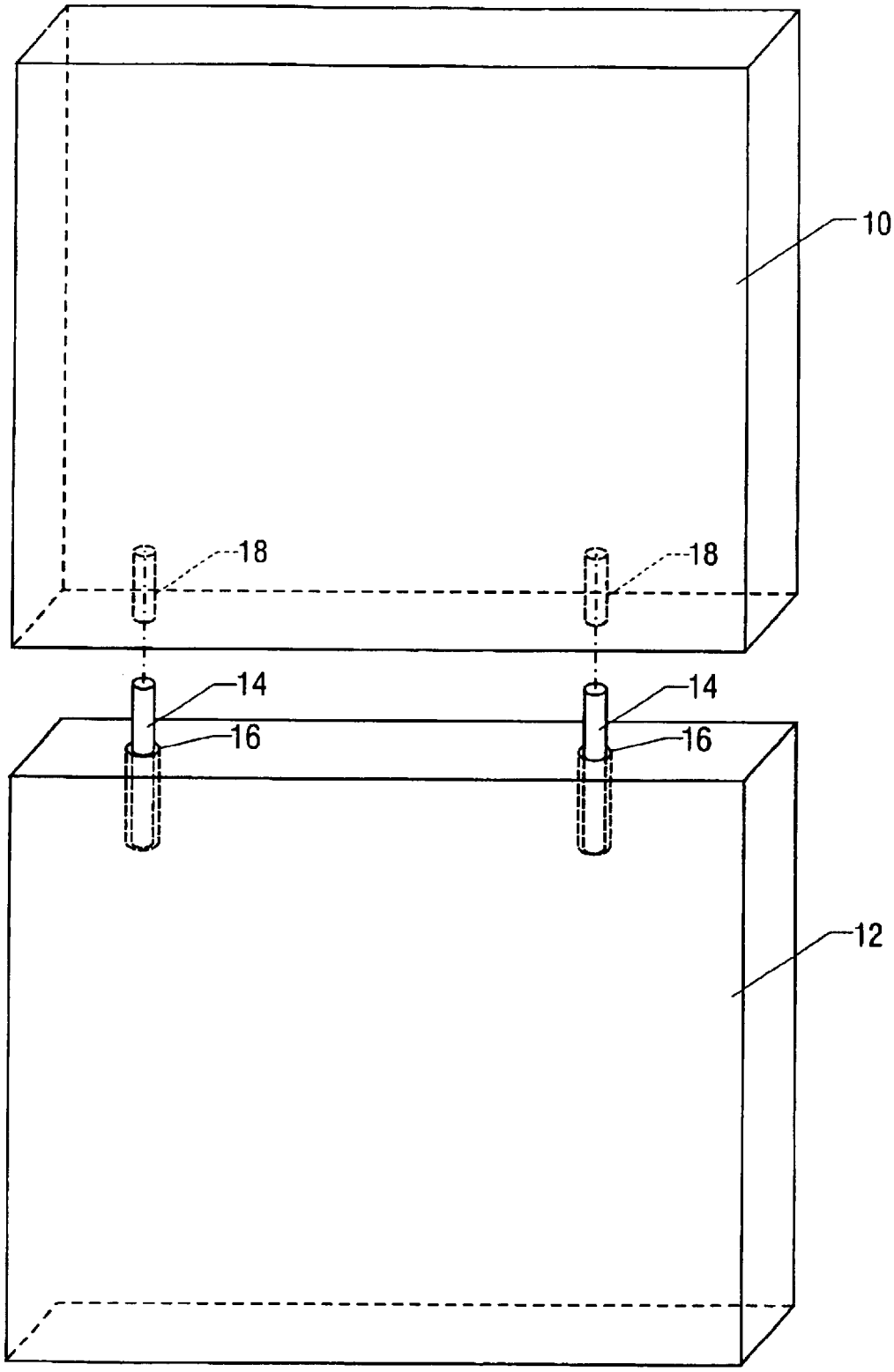
FIG. 1 (Prior Art)
FIG. 1 illustrates a prior art method of setting stones in vertical series
Figure 2:
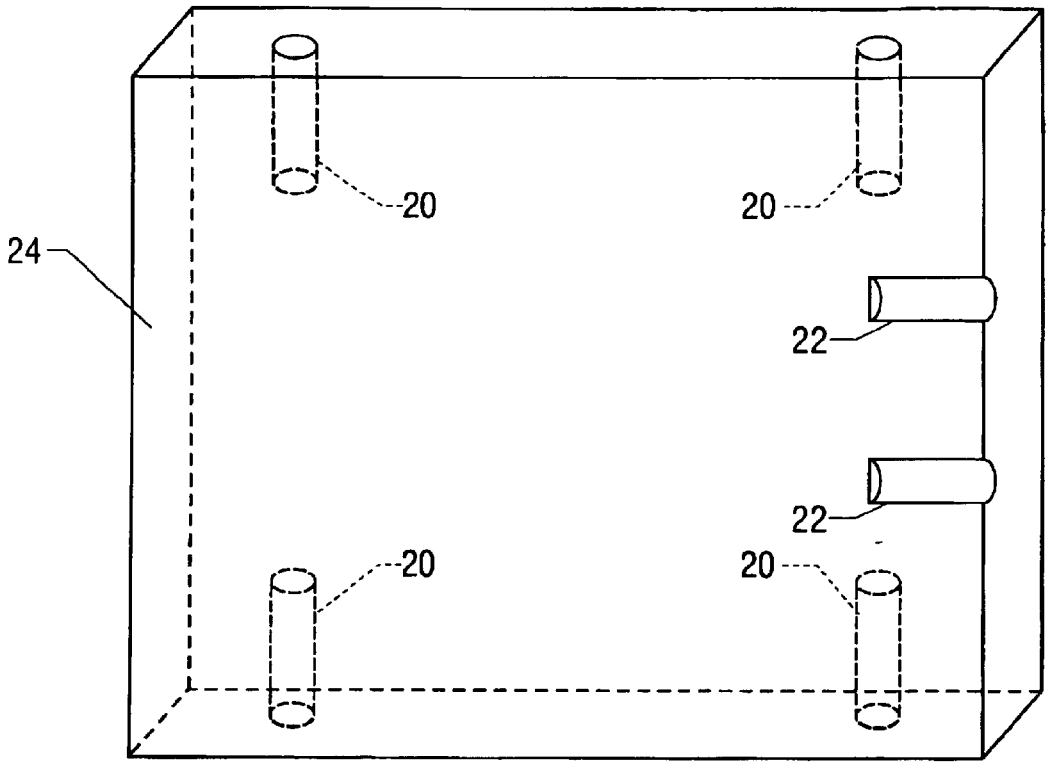
FIG. 2(Prior Art)
FIG. 2 illustrates a prior art method of setting replacement stones in multiple orientation.

FIG. 1 illustrates a prior art method of setting masonry stones 10, 12 in new construction. Typically, the new construction method for connecting masonry stones having only one direction of alignment is to drill the first stone, e.g, bottom stone 12, in the series and set the dowel 14 into the drilled stone with adhesive 16, such as mortar or epoxy or other accepted construction adhesive. The next adjacent stone, e.g., top stone 10, is drilled 18 as was the first stone and adhesive 16 is place into the hole(s). The second stone 10 is placed onto the protruding dowel pin(s) 14 and set into place Shown in FIG. 2 is a prior art method of setting stones with multiple orientation alignment pins in a new construction. Typically, multiple orientation in new construction means horizontal and vertical orientations, but the present invention is not limited to just those orientations. As described with reference to FIG. 1, the aligning pins are implemented in one direction or orientation by drilling holes 20 in one of the orientations. The second or next alignment orientation is achieved by slotting or grooving 22 the stone for receiving pins perpendicular (or otherwise out of orientation) to the first dowel and set in adhesive. For the stone shown in FIG. 2, face 24 is the building face.

Figure 3:
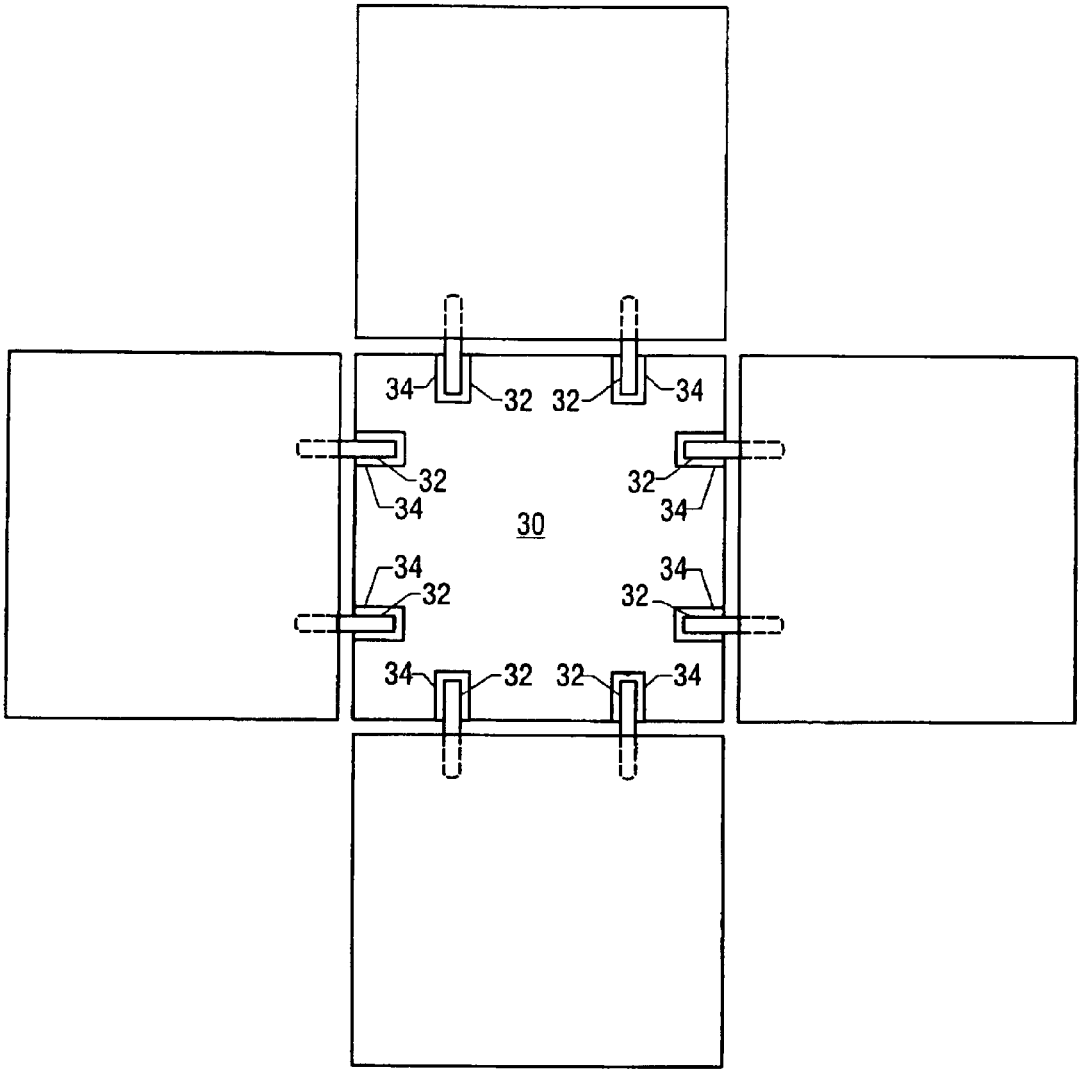
FIG. 3 (Prior Art)
FIG. 3 illustrates a prior art method of restoring existing stones in multiple orientations.

Shown in FIG. 3 is a prior art method of replacing an individual stone 30 in an existing construction. Typical, the old, damaged stone (not shown) is removed by shattering the stone where possible, or by cutting the aligning pins and removing the stone basically intact. Shattering the stone affords the option of reusing the existing alignment pins 32. As described with reference to FIG. 2, the replacement stone has slots or grooves 34 as opposed to holes. In some instances, as shown in FIG. 3, the replacement stone 30 may have a combination of holes and slots.

The present invention is directed to a pin assembly and method for new and repair construction utilizing structurally stronger holes and not slots or grooves. In a first embodiment of the present invention a single orientation repair will be described. After the damaged stone has been removed, bottom alignment pins are set in the remaining bottom stone. Pin holes are drilled into the remaining top stone. The depth of the pin hole will be, preferably, slightly deeper than the pin is long. For example, for a pin having a length of 4 inches, the hole would be drilled preferably to 4⅛ inches. The pin assembly of the present invention is thereafter set into the hole with adhesive. The repair stone has already been drilled to receive the several alignment pins and is placed into position by aligning the bottom holes with the protruding pins in the bottom stone and angling the stone into position. Once the replacement stone is in position the pin assembly of the present invention, which is present in the top most stone, is activated and the alignment pin engages the pin hole in the top of the replacement stone. Thus, the present invention provides for replacement of damaged masonry stones with an alignment pin system having strength similar to of new construction.

Figure 4:
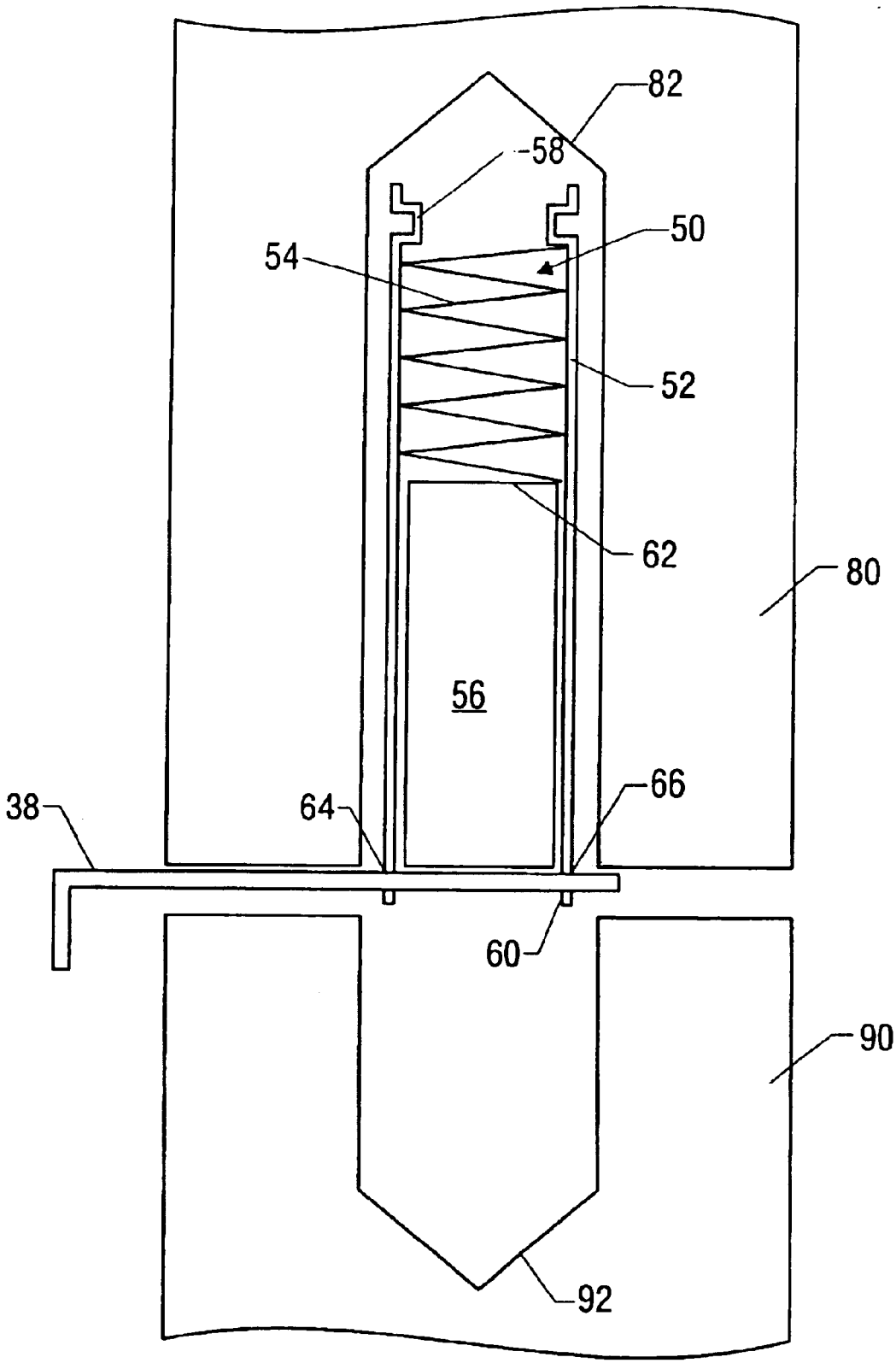
FIG. 4 illustrates an installed, but untriggered pin assembly according to the present invention.

A preferred embodiment of the pin assembly of the present invention is shown in cross-section in FIG. 4. The pin assembly 50 comprises a substantially cylindrical member or cartridge 52, a biasing element 54, a dowel or pin 56 and a trigger 38. The cartridge is crimped at one end to retain the biasing element 54 and to react its biasing force. Alternatively, the cartridge may have a completely closed-off end (not shown) or a partially closed-off end (not shown. Those persons of ordinary skill in the art will appreciate that the present invention contemplates numerous cartridge structures that function to retain the biasing element 54 within the cartridge 52. The cartridge 52 also includes an open end 60. Preferably, the cartridge 52 is fabricated from a substantially non-corrosive metal or other suitable material, such as a 300-series stainless steel. The actual material chosen will depend on the specific application for the pin assembly.

The pin 56 is preferably solid, but may also be hollow like the cartridge. When hollow (not shown), the pin may have opened, closed or a combination of open and closed ends. Whether the pin 56 is hollow or solid, it is beneficial to maximize the pin's surface area contact with the adhesive to hold the pin in place. The pin 56 is configured to slidably reside within the cartridge. The pin 56 is also preferably made from a non-corrosive material, such as stainless steel, and has a length that is preferably shorter than the length inside of the cartridge plus the length of the compressed or loaded biasing element as shown.

The biasing element 54 is preferably a spring fabricated from stainless steel or other non-corrosive material. The biasing element 54 is located between the crimped end 58 of the cartridge and the inner end 62 of the pin 56. In its loaded or compressed condition, the biasing element urges the pin 56 to slide out of the cartridge 52 and unless the pin 56 is restrained, it will tend to do so. The biasing element 54 should have enough kinetic energy to push the majority of the pin 56 out of the cartridge 52 and into the hole of an adjacent stone (not shown), which may or may not be filled with adhesive.

Figure 5:
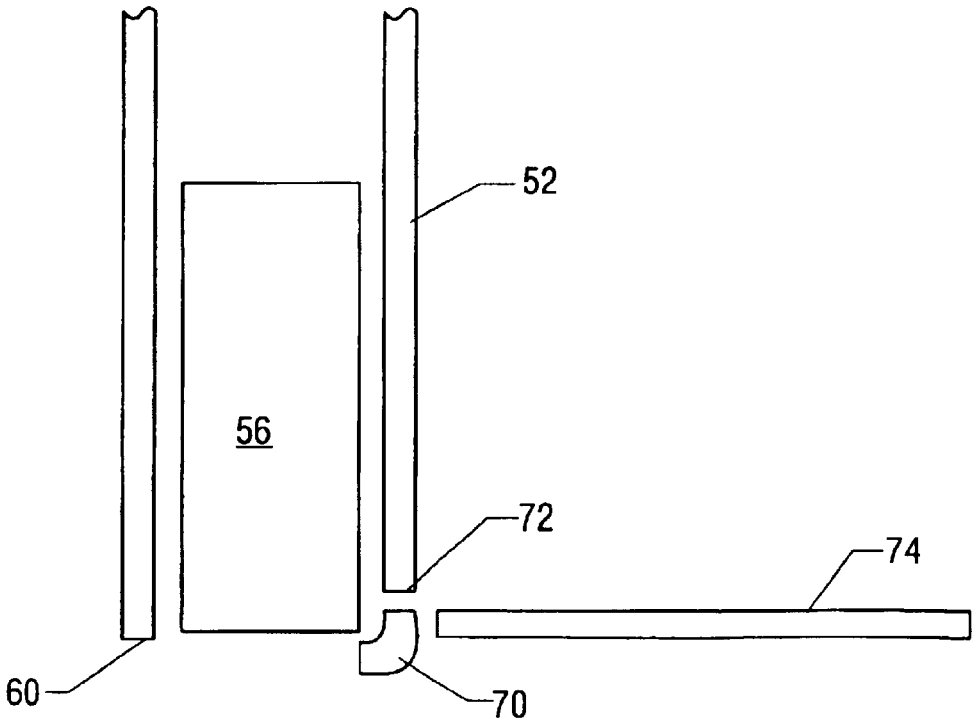
FIG. 5 illustrates an alternate embodiment for a trigger of the present invention.

The assembly also includes a trigger 38 that prevents the pin 56 from sliding out of the cartridge 52 until the trigger 38 is activated. In this preferred embodiment, the trigger comprises an L-shaped piece of metal wire sufficiently strong to withstand the force of the biasing element 54 as applied by the pin 56. The metal wire retainer is fed through preferably two holes 64, 66 located immediately adjacent the open end 60 of the cartridge 52. In this way, the biasing element force is reacted by the cartridge 52 and the pin 56 remains within the cartridge until the trigger 38 is removed. Alternate embodiments of the trigger are contemplated by Applicant. For example, as shown in FIG. 5, the trigger may alternately comprise a "ledge" 70 or other obstruction within the cartridge adjacent the open end 60. The pin can be retained within the cartridge 52 by cocking the pin 56 against this ledge 70. The pin can be released by moving the pin 56 off of this ledge 70. For example, a small hole 72 can be drilled through the cartridge 52 wall behind the ledge and a wire 74 or other device can be used to push the pin 56 off of the ledge 70.

The pin assembly 50 is shown set into place in stone 80 in hole 82 drilled herein. Also, shown in adjacent stone 90 and hole 92 drilled therein. As shown in FIG. 4, the trigger 58 has not yet been activated, but it will be appreciated that when trigger 58 is removed from cartridge 52, biasing element 54 will drive pin 56 into hole 92.

Dimensions for a typical pin assembly 50 according to the present invention are: cartridge length: 2½"; cartridge diameter: 7/16" ID; pin length: 2"; pin diameter: ⅜" OD; and compressed spring length ⅜"

A preferred method of using the pin assembly will now be described. First, the pin assembly holes are drilled into the existing stone or stones. Next, the holes are partially filled with adhesive. The pin assembly of the present invention is installed in the predrilled, adhesive filled holes with the trigger mechanism of the pin assembly accessible to the mason. The stone to be set is drilled with corresponding holes and partially filled with adhesive. The new stone is positioned and set in place. The mason then activates the trigger mechanism to release the pin from the cartridge into the new stone.

Thus, with the benefit of the foregoing disclosure, it will be apparent to those of ordinary skill in the art that the present invention is susceptible to implementation in a variety of embodiments. This disclosure is not intended to limit or otherwise circumscribe the breadth of applicant's invention, but merely to disclose the inventive concept by reference to the currently preferred embodiment.

What is claimed is:

1. A masonry pin assembly comprising:

a substantially cylindrical cartridge that has the interior surface obstructed at one end and wherein the cartridge is adapted to reside within a hole drilled in a masonry stone;

a spring dimensioned to fit within the cartridge and configured to react against the obstructed end of the cartridge;

a retaining pin dimensioned to slidably reside within the cartridge and having a length such that when the spring is compressed within the cartridge by the pin, the pin does not protrude from the cartridge;

a trigger having at least a portion thereof residing on the cartridge for holding the pin within the cartridge against the spring until such time as the trigger is activated and a portion of the pin is released from the cartridge and wherein the trigger can be activated from outside the masonry stone in which the cartridge resides; and wherein the spring is of sufficient strength to drive the retaining pin into a corresponding hole provided in another adjacent masonry stone.

2. The masonry pin of claim 1, wherein the interior surface of the cartridge is obstructed by crimping the cartridge wall.

3. The masonry pin of claim 1, wherein the interior surface of the cartridge is obstructed by closing off at least a portion of an end of the cartridge.

4. The masonry pin of claim 1, wherein the retaining pin is solid.

5. The masonry pin of claim 1, wherein the retaining pin is hollow.

6. The masonry pin of claim 1, wherein the cartridge and retaining pin are fabricated from a non-corrosive metal.

7. The masonry pin of claim 1, wherein the trigger is a wire that reacts against the interior surface of one or more holes in the cartridge wall to hold the retaining pin in the cartridge until such time as the wire is removed.

8. The masonry pin of claim 1, wherein the trigger comprises a ledge on the interior surface of the cartridge wall for holding the retaining pin in the cartridge and a rod for pushing the retaining pin off the ledge.

9. A masonry pin assembly comprising:

a hollow elongated body having the interior surface obstructed at one end;

a spring residing within the body and configured to react against the obstructed end;

a pin dimensioned to slidably reside within the body and having a length such that substantially all of the spring and pin can reside within the body; and a retainer for holding the pin within the body against expulsion of a portion of the pin therefrom by the spring until such time as the retainer is deactivated from outside the cartridge.

10. The assembly of claim 9 wherein the obstructed end is created by crimping the body.

11. The assembly of claim 9, wherein the obstruction is created by closing off at least a portion of an end of the body.

12. The assembly of claim 9, wherein the pin is solid.

13. The assembly of claim 9, wherein the pin is hollow.

14. The assembly of claim 9, wherein the body and pin are fabricated from a non-corrosive metal.

15. The assembly of claim 9, wherein the retainer comprises a wire that reacts against the interior surface of one or more holes in the body to hold the pin in the body until such time as the wire is removed.

16. The assembly of claim 9, wherein the retainer comprises a ledge in the body for holding the pin in the body and wherein the retainer can be deactivated by using a rod to force the pin off the ledge.

17. An assembly for connecting masonry stones one to another comprising:

a substantially cylindrical hollow cartridge in which one end of the cartridge has been crimped such that the interior is obstructed, two radially collinear holes through the cartridge wall immediately adjacent the unobstructed end and wherein the cartridge is adapted to reside within a hole drilled in a masonry stone;

a spring dimensioned to fit within the cartridge and configured to react against the crimped obstruction and the spring having sufficient energy when compressed to drive the retaining pin into a corresponding hole provided in an adjacent masonry stone;

a retaining pin dimensioned to slidably reside within the cartridge and having a length such that when the spring is compressed within the cartridge by the pin, substantially all of the pin resides within the cartridge; and a rod dimensioned to pass through the two radially collinear holes and thereby hold the pin within the cartridge against the spring until such time as the rod is removed from the cartridge thereby causing at least a portion of the retaining pin to be expelled from the cartridge and into a hole in an adjacent masonry stone.

18. A masonry pin assembly comprising:

a substantially cylindrical cartridge that has the interior surface obstructed at one end and wherein the cartridge is adapted to reside within a hole drilled in a masonry stone;

a spring dimensioned to fit within the cartridge and configured to react against the obstructed end of the cartridge;

a retaining pin dimensioned to slidably reside within the cartridge and having a length such that when the spring is compressed within the cartridge by the pin, the pin does not protrude from the cartridge;

a trigger comprising a ledge on the interior surface of the cartridge wall for holding the retaining pin in the cartridge and a rod for pushing the retaining pin off the ledge thereby releasing a portion of the pin from the cartridge and wherein the trigger can be activated from outside the masonry stone in which the cartridge resides; and wherein the spring is of sufficient strength to drive the retaining pin into a corresponding hole provided in another adjacent masonry stone.

19. A masonry pin assembly comprising:

a hollow elongated body having the interior surface obstructed at one end;

a spring residing within the body and configured to react against the obstructed end;

a pin dimensioned to slidably reside within the body and having a length such that substantially all of the spring and pin can reside within the body; and a retainer for holding the pin within the body against expulsion of a portion of the pin therefrom by the spring until such time as the retainer is deactivated from outside the cartridge, wherein the retainer comprises a ledge in the body for holding the pin in the body and a rod to force the pin off the ledge.

20. A method of connecting masonry elements comprising:

providing a first masonry element having at least one blind hole in an edge surface;

providing a second masonry element having at least one blind hole in an edge surface;

securing a masonry attachment device in the at least one hole of the first element, the attachment device comprising a hollow elongated body having the interior surface obstructed at one end; a spring residing within the body and configured to react against the obstructed end; a pin dimensioned to slidably reside within the body and having a length such that substantially all of the spring and pin can reside within the body; and a retainer for holding the pin within the body against expulsion of a portion of the pin therefrom by the spring until such time as the retainer is deactivated from outside the cartridge;

placing the second masonry element adjacent the first masonry element so the at least one blind hole in each are substantially aligned; and deactivating the retainer so that a portion of the pin is expelled from the attachment device secured in the first element and into the blind hole of the second element.

* * * * *